US007238296B2

(12) United States Patent
Moriya

(10) Patent No.: US 7,238,296 B2
(45) Date of Patent: Jul. 3, 2007

(54) RESISTIVE COMPOSITION, RESISTOR USING THE SAME, AND MAKING METHOD THEREOF

(75) Inventor: Satoshi Moriya, Nagano (JP)

(73) Assignee: KOA Kabushiki Kaisha, Ina-shi (JP)

( * ) Notice: Subject to any disclaimer, the term of this patent is extended or adjusted under 35 U.S.C. 154(b) by 554 days.

(21) Appl. No.: 10/646,805

(22) Filed: Aug. 25, 2003

(65) Prior Publication Data

US 2004/0051085 A1 Mar. 18, 2004

(30) Foreign Application Priority Data

Sep. 13, 2002 (JP) ..... 2002-267610

(51) Int. Cl.
*H01C 7/00* (2006.01)
*H01C 3/00* (2006.01)
*C22C 9/05* (2006.01)

(52) U.S. Cl. ..... 252/62.3 R; 252/62.03 T; 252/62.3 C; 252/500; 252/506; 252/512; 338/334; 338/315; 420/468; 420/487

(58) Field of Classification Search ..... 252/62.3 R, 252/62.3 T, 503, 511, 512, 62.3 C, 500, 506; 338/334, 315; 106/31.13; 420/469, 487; 427/101, 103; 29/610.1, 612
See application file for complete search history.

(56) References Cited

U.S. PATENT DOCUMENTS

| | | | | |
|---|---|---|---|---|
| 3,451,808 | A * | 6/1969 | Thielmann | 420/471 |
| 3,847,602 | A * | 11/1974 | Blinov et al. | 420/489 |
| 5,198,154 | A * | 3/1993 | Yokoyama et al. | 252/514 |
| 5,980,785 | A * | 11/1999 | Xi et al. | 252/512 |
| 6,849,109 | B2 * | 2/2005 | Yadav et al. | 106/31.13 |

FOREIGN PATENT DOCUMENTS

| | | | |
|---|---|---|---|
| JP | 8-83969 | A | 3/1996 |
| JP | 9-213503 | A | 8/1997 |
| JP | 2002-50501 | A | 2/2002 |
| JP | 2002-367804 | * | 12/2002 |
| WO | WO 9603466 | A1 * | 2/1996 |

* cited by examiner

*Primary Examiner*—Mark Kopec
*Assistant Examiner*—Kallambella Vijayakumar
(74) *Attorney, Agent, or Firm*—Smith Patent Office

(57) ABSTRACT

When the entire amount of conductive metal mixed powder made of copper, manganese, and germanium is 100 parts by weight, the metal mixed powder is formed by mixing 4.0 to 13.0 parts manganese by weight, 0.2 to 1.4 parts germanium by weight, and 85.6 to 95.8 parts copper by weight, and 0 to 10 parts glass powder by weight and 0 to 10 parts copper-oxide powder by weight are mixed relative to the entire amount (100 parts by weight) of these metal components. The obtained resistive paste is then baked, and the resistive composition having the low resistance value and low TCR may be obtained. In addition, a resistor is made by forming the resistive element upon a substrate.

2 Claims, 3 Drawing Sheets

RESISTIVE COMPOSITION, RESISTOR USING THE SAME, AND MAKING METHOD THEREOF

BACKGROUND OF THE INVENTION

1. Field of the Invention

The present invention relates to a resistive composition to be used for a resistor to detect electric currents that flow in the current detecting circuits or the like, a resistor using the same, and a making method thereof.

2. Description of the Related Art

For the purpose of detecting electric currents that flow in the electronic circuits and/or power circuits of an equipment or the like, resistors having low resistance value and low temperature coefficient of resistance (TCR) have been needed. Such resistors have used resistive element such as silver (Ag)-palladium (Pd), copper (Cu)-nickel (Ni), or copper-manganese (Mn) alloy so as to obtain the low resistance characteristic, as disclosed in, for example, Laid-open Japanese Patent Application Nos. 8-83969 and 9-213503.

A current detecting chip resistor, which uses as a resistive composition copper-nickel alloy, copper-manganese-tin (Sn) based alloys, copper-manganese-germanium (Ge) based alloys, or the like, and which controls deterioration of electric current detection accuracy due to the resistor temperature variation, has been proposed and, for example, is disclosed in Laid-open Japanese Patent Application No. 2002-50501.

However, in the case of the above-mentioned copper-nickel composition resistive element, since the intrinsic property of copper, namely, its resistance value and the TCR (temperature coefficient of resistance) is dominant, the TCR increases as the resistance value decreases. Additionally, there is a problem with the copper-manganese resistor that its intrinsic resistance value varies. Due to this, the resistive paste cannot obtain the desired property (electric current detection precision).

Furthermore, in the case of the above-mentioned copper-nickel resistive element, since its electric resistivity is high, (0.65 μΩm), there is a problem where it is impossible to attain the recently demanded resistance value.

For example, when the copper-nickel composition is 60:40, the sheet resistance is 35 mΩ/□, and the TCR is $50\times10^{-6}$/K. Additionally, when the copper-nickel composition is 90:10, the sheet resistance is 15 mΩ/□, and the TCR is $1200\times10^{-6}$/K.

This invention is provided by taking the above-mentioned problems into account; its objective is to provide a low TCR resistive composition having low resistance value, a resistor using the same, and making method thereof

SUMMARY OF THE INVENTION

The following configuration is provided as an example of a means for achieving the objectives and solving the above-mentioned problems. Namely, the resistive composition according to the present invention includes: a first metal mixed powder made of copper powder, manganese powder, and germanium powder and/or a second metal mixed powder made of copper, manganese, and germanium that includes alloy powder made of at least two or more of the metals copper, manganese, and germanium; glass powder and/or copper-oxide powder; and a vehicle including resin and solvent.

For example, the resistive composition includes a mixture of 85.6 to 95.8 parts copper by weight, 4.0 to 13.0 parts manganese by weight, and 0.2 to 1.4 parts germanium by weight when the entire amount of the first metal mixed powder and/or the second metal mixed powder is 100 parts by weight; and 0 to 10 parts glass powder and/or copper-oxide powder by weight, and 10 to 15 parts vehicle by weight relative to the 100 parts metal mixed powder by weight. In addition, the copper oxide is made of either CuO or $Cu_2O$.

The following configuration is provided as an example of another means for solving the above-mentioned problems. Namely, a resistor according to the present invention forms upon an insulating substrate resistive element containing 0 to 10 parts glass powder and/or copper-oxide powder by weight relative to 100 parts metal components by weight, when the metal component containing copper, manganese, and germanium is 100 parts by weight. For example, the copper oxide is made of either CuO or $Cu_2O$.

Furthermore, the following configuration is provided as a means of solving the above-mentioned problems. Namely, a making method of the resistive composition according to the present invention includes: a first step of forming a first metal mixed powder made of copper powder, manganese powder, and germanium powder and/or a second metal mixed powder made of copper, manganese, and germanium that includes alloy powder made of at least two or more of the metals copper, manganese, and germanium; a second step of mixing 0 to 10 parts glass powder and/or copper-oxide powder by weight relative to 100 parts first metal mixed powder and/or second metal mixed powder by weight; and a third step of mixing 10 to 15 parts vehicle by weight including resin and solvent relative to the entire amount mixed in the first and second steps; and mixes 85.6 to 95.8 parts copper by weight, 4.0 to 13.0 parts manganese by weight, and 0.2 to 1.4 parts germanium by weight when the entire amount of the first metal mixed powder and/or the second metal mixed powder is 100 parts by weight. For example, the copper oxide is made of either CuO or $Cu_2O$.

The following configuration is also provided as an example of another means of solving the above-mentioned problems. Namely, a making method of a resistor according to the present invention includes: a step of weighing metal components of copper, manganese, and germanium; a step of forming resistive elements containing 0 to 10 parts glass powder and/or copper-oxide powder by weight relative to 100 parts weighed metal components by weight; and a step of forming the resistive elements upon an insulating substrate. For example, the copper oxide is made of either CuO or $Cu_2O$.

DETAILED DESCRIPTION OF THE INVENTION

Figure 1:
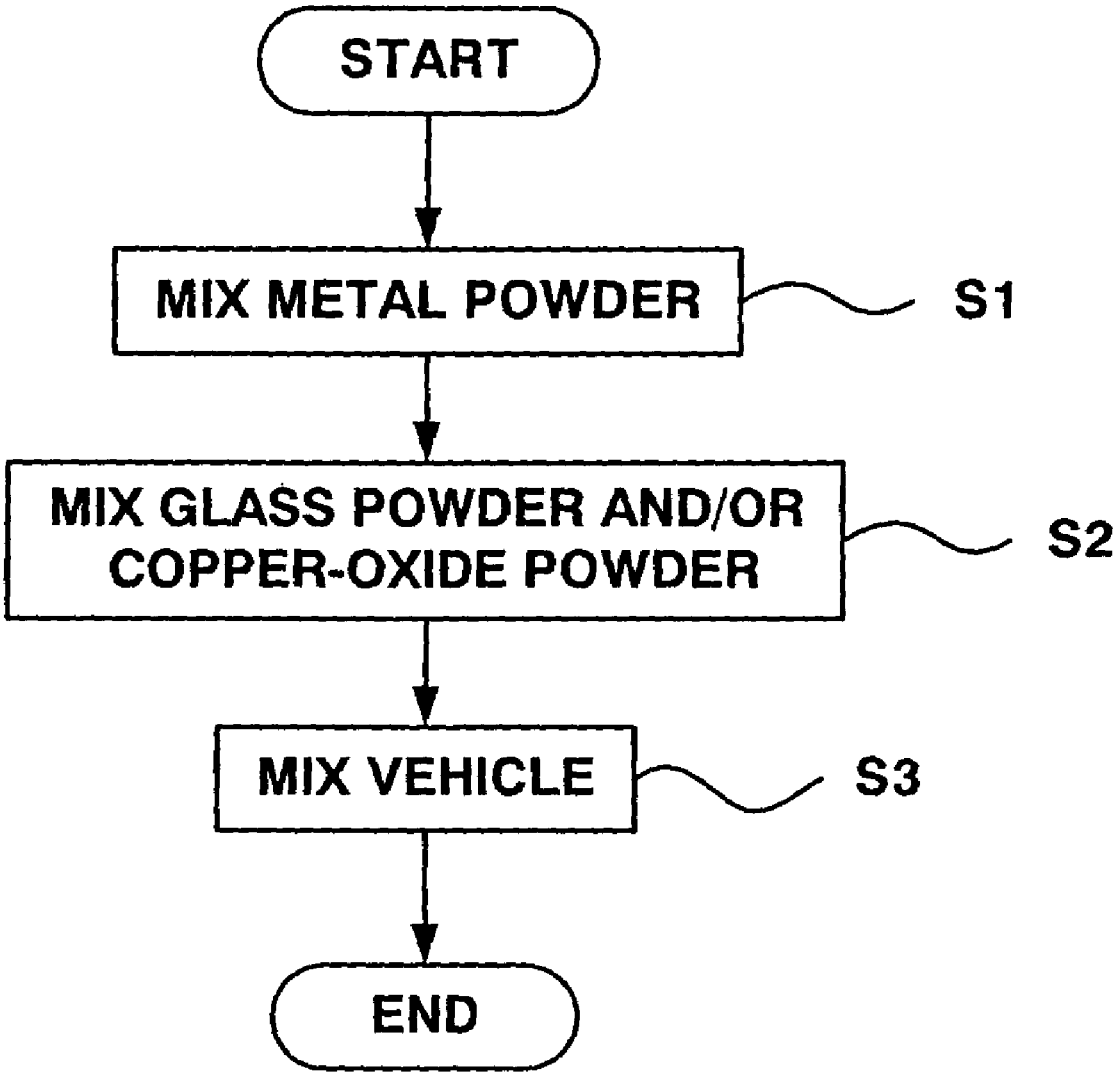
FIG. 1 is a flowchart showing a making process of the resistive paste according to an embodiment of the present invention.

An exemplary embodiment of the present invention is described in detail forthwith while referencing accompanied drawings and a table. For the resistive paste according to this embodiment, for example, the resistive paste, which is a resistive composition, is made of a first conductive metal mixed powder containing copper powder, manganese powder, and germanium powder and/or a second metal mixed powder made of copper, manganese, and germanium which includes alloy powder made of at least two or more of the metals copper, manganese, and germanium; glass powder and/or copper-oxide powder (copper oxide powder) to be mixed with the metal mixed powder; and vehicle including resin and solvent, and a resistor is made by using this resistive paste.

In the metal mixed powder of the above-mentioned first and/or second resistive paste, when the entire amount of mixed powder is 100 parts by weight, 4.0 to 13.0 parts manganese by weight, 0.2 to 1.4 parts germanium by weight, and 85.6 to 95.8 parts copper by weight are mixed as metal components. In addition, the above-mentioned glass powder is 0 to 10 parts by weight, and copper-oxide powder is 0 to 10 parts by weight relative to the entire amount (100 parts by weight) of such metal components.

The glass powder is to be used for the purpose of physical adhesion of the adhesive components with a substrate to be described later; if the ratio of the glass powder exceeds 10 parts by weight, it is not appropriate since the electrical resistivity will increase. In addition, the copper-oxide powder is to be used for the purpose of chemical adhesion of the adhesive components with the substrate; if the ratio of the copper-oxide powder exceeds 10 parts by weight, the resistive layer becomes porous, and the smoothness of the resistive layer is degraded.

Note that the resistive paste according to this embodiment contains at least either the glass powder or copper-oxide powder as such adhesive components, and combination of both as being 0 parts by weight is excluded since adhesion with the substrate is lost.

Moreover, in this embodiment, the viscosity of the resistive paste suitable for printing is preferably achieved by compounding 10 to 15 parts vehicle by weight including resin and solvent in order to make the resistive elements be paste. In addition, the amount of composition exceeding this range may be possible depending on the printability.

In the resistive paste according to this embodiment, other than the metal mixed powder made of copper, manganese, and germanium powders, the metal powder that includes alloy powder made of at least two or more of such metals may be used as the conductive metal mixed powder, or both powders may be used.

In any of the case described above, if the ultimate combined mixture ratio of copper, manganese, and germanium is the above-mentioned ratio, the desired property such as the resistance value and TCR of the resistive paste may be obtained.

The metal powder (copper, manganese, and germanium powders), which is a conductive metal mixed material of the resistive paste, preferably has a particle diameter within an allowable range for screen printing onto a substrate. For example, the range of the particle diameter is preferably between 0.1 μm and 20 μm.

The material suitable as the glass powder of the resistive paste according to this embodiment is preferably a borosilicate based glass as the composition, which has not only adhesion with an insulating substrate to form resistive layers using that resistive paste and various stabilities necessary for the resistive element, but also from the view of workability, has acid resistance and water resistance with a softening point at 500 to 1000° C.

Accordingly, a borosilicate barium based glass, a borosilicate calcium based glass, a borosilicate barium calcium based glass, a borosilicate zinc based glass, a zinc borate based glass, or the like may be used as the glass powder.

In addition, the particle diameter of the glass powder is preferably within the allowable range for screen printing, for example, the particle diameter is preferably between 0.1 μm and 20 μm. More specifically, the average particle diameter is preferably 2 μm or less.

In this embodiment, the material suitable as the copper oxide of the copper-oxide powder preferably has adhesiveness with the insulating substrate to form the resistive layer using the resistive paste, and various stabilities necessary for the resistive element. For example, both CuO (copper oxide) and $Cu_2O$ (copper monoxide) may be used. In addition, the particle diameter of the copper-oxide powder is preferably within the allowable range for screen printing, for example, the particle diameter is preferably between 0.1 μm and 20 μm; more specifically, the average particle diameter is preferably 2 μm or less.

Meanwhile, as a resin to be used for vehicle made of resin and solvent of the resistive paste according to this embodiment, for example, cellulosic resin, acrylic resin, alkyd resin, or the like may be used independently or a combination of them may be used. More specifically, for example, ethyl cellulose, ethyl acrylate, butyl acrylate, ethyl methacrylate, butyl methacrylate, or the like may be possible.

In addition, for example, a terpene based solvent, an ester alcohol based solvent, an aromatic hydrocarbon based solvent, an ester based solvent, or the like may be used independently, or in combination as the solvent to be used for the vehicle made of resin and solvent of the resistive paste. More specifically, for example, terpineol, dihydroterpineol, 2,2,4-trimethyl-1,3-pentanediol, texanol, xylene, isopropylbenzene, toluene, acetic acid diethylene glycol monomethyl ether, acetic acid diethylene glycol monoethyl ether, acetic acid diethylene glycol monobutyl ether, or the like may also be possible.

Note that the configuration of the vehicle is not limited to the above-mentioned resin and solvent, but various additives may be added in order to improve the resistive paste characteristics.

FIG. 1 illustrates a making process of the resistive paste, which is a resistive composition according to this embodiment. In step S1 in the drawing, the metal powder used as the conductive metal mixed material of the resistive paste is mixed. In this case, copper, manganese, and germanium powders are mixed.

A specific compounding ratio of such metal powder is, as described above, 85.6 to 95.8 parts copper powder by weight, with, for example, the average particle diameter of 1.1 μm, 4.0 to 13.0 parts manganese powder by weight, having, for example, the average particle diameter of 10 μm, and 0.2 to 1.4 parts germanium powder by weight, with, for example, the average particle diameter of 10 μm mixed when, for example, the entire metal mixed powder is 100 parts by weight.

In the following step S2, the glass powder and/or copper-oxide powder are mixed with the metal mixed powder mixed in the above step S1. In this case, for example, 0 to 10 parts glass powder by weight and 0 to 10 parts copper-oxide powder by weight are mixed relative to the entire amount of Cu—Mn—Ge metal powder.

In step S3, the vehicle is mixed. The resistive paste is made by adding 10 to 15 parts vehicle made of organic resin and solvent (for example, texanol solution containing 2.5 weight percent ethyl cellulose) by weight relative to the entire amount to which the above-mentioned Cu—Mn—Ge metal mixed powder and glass powder and/or copper-oxide powder are mixed, and kneading them with a 3-roll mill.

According to this embodiment, the resistive element is made by printing the resistive paste obtained as described above so as to be extended across the copper electrodes, which have been formed upon the alumina substrate containing 96 weight percent alumina. The resistive paste is then dried, and sintered in a nitrogen ($N_2$) atmosphere at, for example, 980° C. for 10 minutes. In this case, the size of the resistive element is 1 mm×52 mm in order to prevent from being affected from the copper electrode, and the resistive element film after sintering is 20.3 μm in thickness.

Table 1 shows the characteristics of the resistive element obtained through sintering as described above. According to this embodiment, the resistive paste is made by mixing the Cu—Mn—Ge metal alloy powder in the compounding ratio shown in the table (unit is weight percent (wt %)), adding and fully mixing glass powder (5 wt %) and copper-oxide powder (5 wt %), and further adding vehicle thereto.

Namely, table 1 shows the electrical resistivity (μΩm) and temperature coefficient of resistance (TCR), which are characteristic values of respective resistive elements (sample Nos. 1 to 17) obtained by sintering the above-mentioned resistive paste. Note that the resistive value of the resistive element in determining the electrical resistivity and TCR is measured at 25° C. and 125° C.

TABLE 1

| Sample No. | Cu [wt %] | Mn [wt %] | Ge [wt %] | Electrical Resistivity [μΩm] | TCR × $10^{-6}$/K |
|---|---|---|---|---|---|
| 1 | 83.8 | 16.0 | 0.2 | 0.75 | 45 |
| 2 | 86.8 | 13.0 | 0.2 | 0.63 | 73 |
| 3 | 90.0 | 10.0 | 0.0 | 0.63 | 260 |
| 4 | 91.8 | 8.0 | 0.2 | 0.32 | 92 |
| 5 | 95.8 | 4.0 | 0.2 | 0.35 | 820 |
| 6 | 98.9 | 1.0 | 0.1 | 0.16 | 2200 |
| 7 | 86.7 | 13.0 | 0.3 | 0.60 | 40 |
| 8 | 92.5 | 7.0 | 0.5 | 0.48 | 45 |
| 9 | 98.5 | 1.0 | 0.5 | 0.21 | 1450 |
| 10 | 86.5 | 13.0 | 0.5 | 0.61 | 55 |
| 11 | 89.8 | 9.5 | 0.7 | 0.47 | 28 |
| 12 | 89.0 | 10.0 | 1.0 | 0.61 | 38 |
| 13 | 95.0 | 4.0 | 1.0 | 0.34 | 90 |
| 14 | 98.0 | 1.0 | 1.0 | 0.25 | 580 |
| 15 | 92.6 | 6.0 | 1.4 | 0.40 | 86 |
| 16 | 96.6 | 2.0 | 1.4 | 0.25 | 330 |
| 17 | 96.2 | 2.0 | 1.8 | 0.38 | 360 |

Now, characteristics of some examples (examples 1 to 3) of the resistive paste according to this embodiment are described. To begin with, example 1 (corresponding to the resistive element, sample No. 11 in Table 1) is described. The resistive paste of the resistive element according to this example 1 is a paste, which is obtained by weighing and mixing 89.8 parts copper powder by weight, 9.5 parts manganese powder by weight, and 0.7 parts germanium powder by weight, adding and fully mixing 5 parts copper-oxide powder by weight and 5 parts glass powder by weight thereto the mixed powder, and further adding 12 parts vehicle by weight to the mixed powder, kneading them with the 3-roll mill.

The resistive element of the obtained resistive paste is made through sintering mentioned above; and the electrical resistivity and temperature coefficient of resistance are determined by measuring the resistance value of that resistive element. In the case of the resistive element of example 1, the electrical resistivity is 0.47 μΩm and the temperature coefficient of resistance is $28\times10^{-6}$/K. Note that the adhesive intensity between the resistive element and substrate is 41.6 N as a result of measuring in the area of 2 mm×2 mm.

Example 2 corresponds to the resistive element of sample No. 7 in table 1; and the resistive paste is obtained by weighing and mixing 86.7 parts copper powder by weight, 13.0 parts manganese powder by weight, and 0.3 parts germanium powder by weight, adding and fully mixing 5 parts copper-oxide powder by weight and 5 parts glass powder by weight to the mixed powder, and further adding 12 parts vehicle by weight to the mixed powder, kneading them with the 3-roll mill.

The electrical resistivity of the resistive element obtained by sintering the resistive paste according to example 2 is 0.60 μΩm and the temperature coefficient of resistance is $40\times10^{-6}$/K, determined by the same method as in the above example 1.

Example 3 corresponds to the resistive element of sample No. 8 in table 1; and the resistive paste is obtained by weighing and mixing 92.5 parts copper powder by weight, 7.0 parts manganese powder by weight, and 0.5 parts germanium powder by weight, adding and fully mixing 5 parts copper-oxide powder by weight and 5 parts glass powder by weight to the mixed powder, and further adding 12 parts vehicle by weight to the mixed powder, kneading them with the 3-roll mill.

The characteristics of the resistive element obtained by sintering the resistive paste according to example 3 are then measured by the same method as in the above example 1. As a result, the electrical resistivity is 0.48 μΩm and the temperature coefficient of resistance is $45\times10^{-6}$/K.

The following resistive element is made as a comparative example. Namely, 57.0 part copper powder by weight and 43.0 parts nickel powder by weight are weighed and mixed, 5 parts copper-oxide powder by weight and 5 parts glass powder by weight are added to the mixed powder and then fully mixed. The resistive paste is obtained by further adding 12 parts vehicle by weight to the mixed powder, and kneading them with the 3-roll mill.

Figure 2:
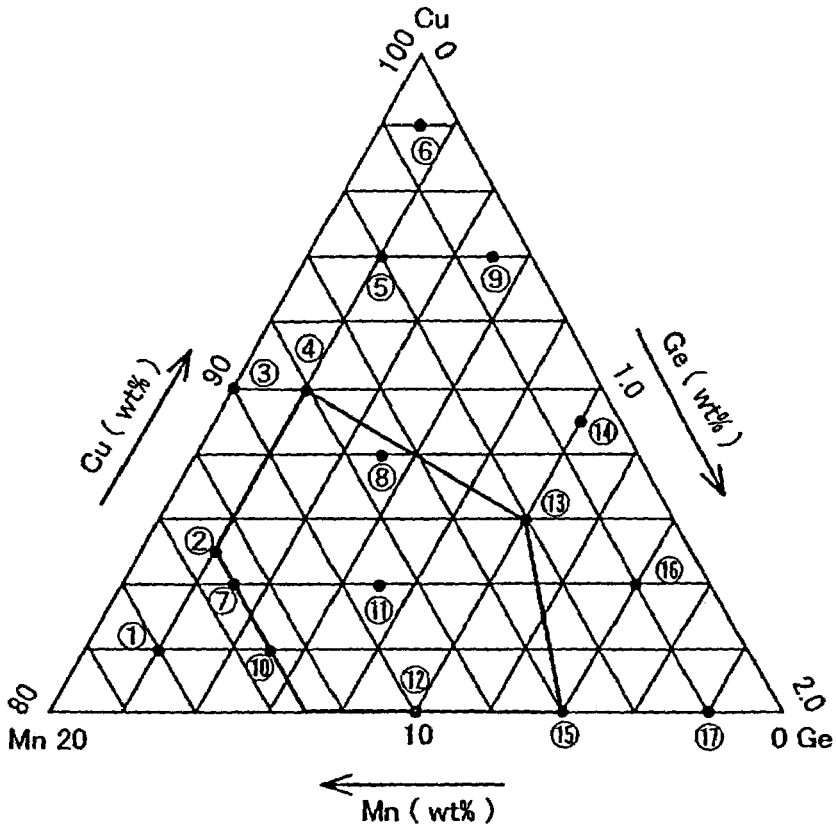
FIG. 2 is a composition diagram showing the composition of the resistive elements according to the embodiment.

As a result of measuring the characteristics of the resistive element obtained by sintering such copper-nickel resistive paste, the electrical resistivity is 0.65 μΩm and the temperature coefficient of resistance is $80\times10^{-6}$/K FIG. 2 is a composition diagram showing composition of the resistive element according to this embodiment. In the drawing, numbers within the circles (○) correspond to sample Nos. 1 to 17 shown in Table 1, respectively, and the Cu—Mn—Ge compounding ratio for each sample is plotted. In addition, in the figure, the Cu—Mn—Ge compounding ratio within the range shown by a bold line is the preferred composition range of the metal components in order to obtain the resistive element having a desired low resistance value and low temperature coefficient of resistance.

Namely, any resistive elements existing outside of the "preferred range" shown in FIG. 2 are not appropriate, since their electrical resistivity may be greater than 0.65 μΩm which is the electrical resistivity of the resistive element made from the conventional copper-nickel resistive paste (see the above-mentioned comparative example), or their temperature coefficient of resistance may be larger than the target value (less than $\pm100\times10^{-6}$/K).

Figure 3:
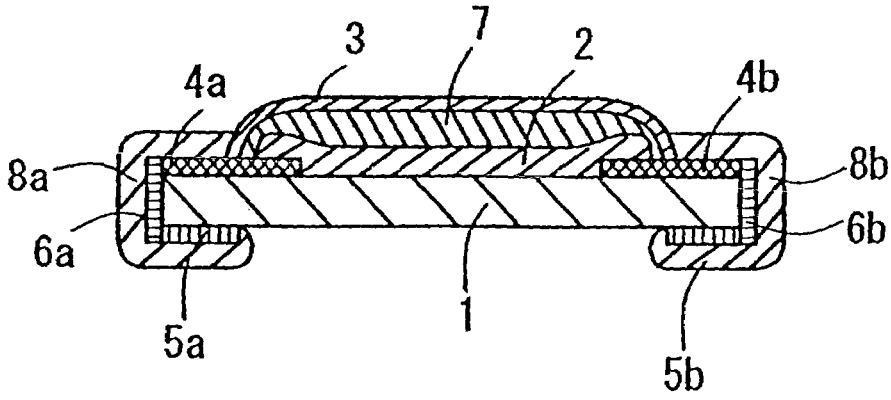
FIG. 3 is a diagram showing a cross-sectional configuration of a chip resistor according to the embodiment.

FIG. 3 shows a cross-sectional configuration of an example of a flat-type chip resistor (hereafter, simply referred to as a chip resistor) using the resistive paste according to this embodiment. In the drawing, a substrate 1 is, for example, an electrically insulating ceramics substrate (insulating substrate) having a chip shape with a predetermined size. A resistive layer 2 is formed upon the substrate 1 by coating the resistive paste made by compounding the above-mentioned metal mixed powder through screen printing, for example, and then sintering thereof.

The top of the resistive layer 2 is coated and protected by a pre glass 7. Furthermore, a protective film 3 functioning as an insulating film is provided upon the pre glass 7. On both ends of the substrate 1 and under both ends of the resistive layer 2 are formed upper electrodes (surface electrodes) 4*a* and 4*b*, which have electrical contact therewith. In addition, lower electrodes (backside electrodes) 5*a* and 5*b* are formed at the ends of the substrate bottom. In order to electrically connect the upper electrodes 4*a* and 4*b* and lower electrodes 5*a* and 5*b*, end electrodes 6*a* and 6*b* are provided between those electrodes at each side end of the substrate 1.

Furthermore, an external electrode 8*a* is formed through plating so as to cover at least one part of the upper electrode 4*a*, the lower electrode 5*a* and end electrode 6*a*. Similarly, an external electrode 8*b* is formed through plating so as to cover at least one part of the upper electrode 4*b*, the lower electrode 5*b* and end electrode 6*b*.

For example, alumina substrate, forsterite substrate, mullite substrate, aluminum nitride substrate, glass ceramics substrate, or the like may be used as an insulating substrate for such resistor.

In addition, metal mixed powder in which metal powders of copper, manganese, and germanium are mixed in the above-mentioned ratio, or alloy powder of copper, manganese, and germanium is used as the conductive metal components of the resistive layer 2. To use mixture of copper, manganese, and germanium powders, they are alloyed during sintering.

Figure 4:
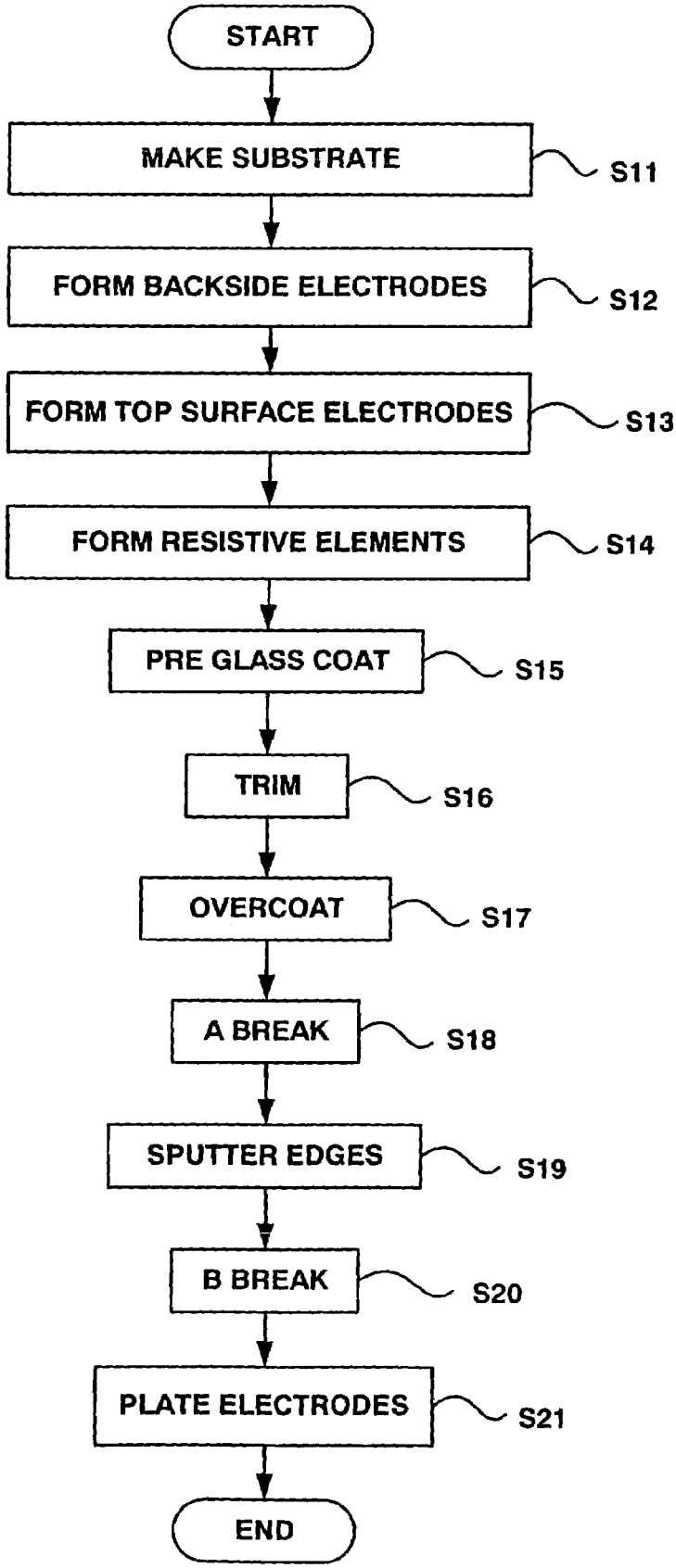
FIG. 4 is a process diagram for describing a making process of a resistor according to the embodiment.

Next, a making process of a resistor according to this embodiment comprising the above-mentioned configuration is described. FIG. 4 is a process diagram for describing the making process of the resistor according to this embodiment. To begin with, in step S11 of FIG. 4, a process of making the above-mentioned substrate 1 is performed. Note that the alumina substrate containing 96 wt % alumina is used as the substrate.

As the shape of the substrate, for example, a rectangular substrate with a size that is equal to that of a predetermined making unit size is made, however, an arbitrary size of the substrate may be made, therefore, substrates each having the size that corresponds to each resistor, or substrates each having the size that corresponds to a plurality of resistors may be made at the same time.

In the following step S12, the lower electrodes (backside electrodes) 5*a* and 5*b* are formed upon the bottom (solder side when mounting the resistor) of the substrate 1 through thick-film printing by screen printing and sintering of the backside electrodes. More specifically, the backside electrodes are formed by printing copper paste (Cu paste) onto the back side of the alumina substrate, then drying it, and sintering it in the nitrogen ($N_2$) atmosphere at, for example, 960° C. for 10 minutes.

Next, in step S13, upper electrodes (surface electrodes) 4*a* and 4*b* are formed upon the top surface (on which the resistor element is to be formed) of the substrate 1 through thick-film printing by screen printing and sintering of the top side electrodes. More specifically, the surface electrodes are formed by printing copper paste on the top side of the alumina substrate, then drying it, and sintering it in the nitrogen atmosphere at, for example, 960° C. for 10 minutes.

Note that the upper electrodes (surface electrodes) 4*a* and 4*b*, and lower electrodes (backside electrodes) 5*a* and 5*b* may be baked simultaneously.

With this embodiment, a problem of reliability degradation due to the electronic migration of silver is prevented by using copper paste as an electrode material, as the conventional resistor, for performing thick-film printing on both the back side and the top side. Also, sintering in the nitrogen ($N_2$) atmosphere, or, inert atmosphere, is to prevent oxidation of copper electrodes. Note that the sintering temperature is not limited to 960° C., but for example, sintering at 980° C. is also possible.

In step S14, for example, the resistive paste thick film is formed by coating the above-mentioned resistive paste between the upper electrodes (surface electrodes) 4*a* and 4*b* so that a portion of the paste is overlapped with the upper electrodes (surface electrodes) 4*a* and 4*b*. This resistive paste thick film is then baked in the nitrogen ($N_2$) atmosphere at 960° C., for example. Note that the sintering temperature may also be 980° C.

In this embodiment, by adding copper oxide to the resistive paste, it is possible to obtain good adhesion between the substrate and resistive element; and with a glass (for example, a ZnBSiOx glass), it is possible to obtain the intensity of inorganic binder film. Furthermore, the vehicles function so as to provide printability using the organic binder.

In step S15, a pre glass-coated thick film is formed through printing, or the like upon the resistive layer 2 which is formed in the above manner, and then dried and baked. In this case, for example, the pre glass coat is formed by printing the ZnBSiOx based glass paste upon the resistive element, then drying it, and finally sintering it in the nitrogen atmosphere at, for example, 670° C. for 10 minutes.

Note that the sintering temperature may also be 690° C. In addition, the glass paste is not limited to the ZnBSiOx based glass paste, but the above-mentioned borosilicate barium based glass, borosilicate calcium based glass, borosilicate barium calcium based glass, borosilicate zinc based glass, or zinc borate based glass may also be used.

Next, in step S16, trimming the resistive element (adjustment of resistance value) is performed if necessary. Through this trimming, the resistance value is adjusted by slitting the resistive element pattern by using, for example, a laser beam or sandblast.

In step S17, for example, an overcoat, which is the protective layer 3 having a function as the insulating layer, is formed by forming epoxy resin through screen printing so as to cover the pre glass coat and a part of upper electrodes 4*a* and 4*b*, and then hardening thereof.

The display section for displaying a resistance value and the like is then formed by printing the epoxy resin upon the overcoat (protective layer 3) as needed, and then hardening thereof.

Furthermore, in step S18, an A break (primary break) is performed to separate the alumina substrate into strips. In the following step S19, the end electrodes 6*a* and 6*b* are formed by forming NiCr alloy layers on the edges of the strip alumina substrate through sputtering. Note that formation of the NiCr alloy layer is not limited to sputtering, but may also be formed through vacuum evaporation, or the like.

In step S20, a B break (secondary break) is then performed and the strip alumina substrate on which the end electrodes 6*a* and 6*b* have already been formed, is further divided into chips. The size of the obtained chips is, for example, 3.2 mm×1.6 mm.

In step S21, the external electrodes 8*a* and 8*b* are formed upon the portion of the upper electrodes 4*a* and 4*b* that is not covered by the protective layer 3, the lower electrodes 5*a* and 5*b*, and the end electrodes 6*a* and 6*b*.

For example, the external electrodes 8*a* and 8*b* are electrolytic nickel (Ni) plated, electrolytic copper (Cu) plated, electrolytic nickel (Ni) plated, and electrolytic tin (Sn) plated in order, that is, a Ni layer—Cu layer—Ni layer—and Sn layer are stacked.

The resistor having 3.2 mm×1.6 mm chip size made as described above is formed so as to have, for example, a 470 μm substrate thickness, 20 μm top side electrode thickness, 20 μm lower side electrode thickness, 30 to 40 μm resistive layer thickness, 10 μm pre glass coat thickness, 30 μm protective layer thickness, 0.05 μm end electrode thickness; and 3 to 7 μm Ni layer thickness, 20 to 30 μm Cu layer thickness, 3 to 12 μm Ni layer thickness, and 3 to 12 μm Sn layer thickness as the external electrode thicknesses in order.

With a method of sintering the resistive paste and post-sintering resistive element when making a resistor by using the resistive paste of this embodiment, the resistive paste is preferably baked in the neutral atmosphere or inert atmosphere (for example, in the nitrogen atmosphere) at 600 to 1000° C. Note that the sintering time of the above-mentioned resistive paste may be set arbitrarily. Accordingly, a copper-manganese-germanium based resistive element, more preferably a copper-manganese-germanium alloy resistive element, may be obtained.

As described above, according to the present invention, the resistive composition and the resistor having a low resistance value and low TCR may be made.

Namely, as material of the resistive paste, by mixing the conductive metal powder such as copper-manganese-germanium (Cu—Mn—Ge) and glass powder and/or copper-oxide powder, sintering them, and making the resistive element, it is possible to further lower the electrical resistivity than that of the resistive element made from the copper-nickel resistive paste, and it is also possible to lower the TCR of that resistive element.

In addition, since a chip resistor using the resistive paste having such characteristics can be made, that chip resistor may become the chip resistor that is most appropriate for an application requiring a resistor that has a low electrical resistivity and low TCR, such as a resistor (shunt resistor) for detecting electric currents that flow in the power circuit and/or motor circuit.

While the invention has been described with reference to particular example embodiments, further modifications and improvements which will occur to those skilled in the art, may be made within the purview of the appended claims, without departing from the scope of the invention in its broader aspect.

What is claimed is:

1. A resistive composition comprising:

a first metal mixed powder made of copper powder, manganese powder, and germanium powder and/or a second metal mixed powder made of copper, manganese, and germanium that includes alloy powder made of at least two or more of the metals copper, manganese, and germanium;

at least one of a glass powder and a copper-oxide powder; and vehicle containing resin and solvent, wherein said resistive composition includes a mixture of 85.6 to 95.8 parts copper by weight, 4.0 to 13.0 parts manganese by weight, and 0.2 to 1.4 parts germanium by weight when the entire amount of said first metal mixed powder and/or said second metal mixed powder is 100 parts by weight; greater than 0 to 10 parts of at least one of said glass powder and said copper-oxide powder by weight; and 10 to 15 parts vehicle by weight relative to 100 parts of said first metal mixed powder and/or said second metal mixed powder by weight.

2. The resistive composition according to claim 1, wherein said copper oxide is made of either CuO or $Cu_2O$.

* * * * *